US005989366A

United States Patent [19]

Hayashi et al.

[11] Patent Number: 5,989,366

[45] Date of Patent: Nov. 23, 1999

[54] METHOD OF MANUFACTURING THICK STEEL PRODUCT OF HIGH STRENGTH AND HIGH TOUGHNESS HAVING EXCELLENT WELDABILITY AND MINIMAL VARIATION OF STRUCTURE AND PHYSICAL PROPERTIES

[75] Inventors: Tohru Hayashi; Mitsuhiro Okatsu; Fumimaru Kawabata; Keniti Amano, all of Okayama, Japan

[73] Assignee: Kawasaki Steel Corporation, Hyogo, Japan

[21] Appl. No.: 08/816,418

[22] Filed: Mar. 14, 1997

[30] Foreign Application Priority Data

Mar. 18, 1996 [JP] Japan ..... 8-087095
Sep. 13, 1996 [JP] Japan ..... 8-263805

[51] Int. Cl.[6] ..... C21D 8/02

[52] U.S. Cl. ..... 148/505; 148/648; 148/654

[58] Field of Search ..... 148/648, 654, 148/661, 550, 505

[56] References Cited

U.S. PATENT DOCUMENTS 4,219,371 8/1980 Nakasugi et al. ..... 148/648
4,521,258 6/1985 Tamehiro et al. ..... 148/505

FOREIGN PATENT DOCUMENTS 0 733 715 9/1996 European Pat. Off. .
6-67621 4/1985 Japan .
61-67717 4/1986 Japan .
63-162838 7/1988 Japan .
4-350127 12/1992 Japan .
6-220576 8/1994 Japan .
7-126746 5/1995 Japan .
2 131 832 6/1984 United Kingdom .

*Primary Examiner*—Sikyin Ip
*Attorney, Agent, or Firm*—Young & Thompson

[57] ABSTRACT

A method of manufacturing a thick steel product of high strength and high toughness having excellent weldability with minimal variation of material properties, comprises heating a steel raw material to the temperature of $Ac_3$ to 1350° C., hot rolling and then cooling at the cooling rate of 10° C./sec. or less. The steel raw material has the following composition:

C: 0.001–0.25 wt %;
Mn: 1.0–3.0 wt %;
Ti: 0.005–0.20 wt %;
Nb: 0.005–0.20 wt %;
B: 0.0003–0.0050 wt %; and
Al: 0.01–0.100 wt % balance substantially Fe and incidental impurities. The composition has a transformation start temperature (Bs) of 670° C. or less. Since the steel product obtained by the method has no variation in physical properties regardless of variation in cooling rate, it is possible to supply steel products of high strength and high toughness which have uniform microstructure and properties along their thickness direction and are excellent in weldability.

11 Claims, 2 Drawing Sheets

METHOD OF MANUFACTURING THICK STEEL PRODUCT OF HIGH STRENGTH AND HIGH TOUGHNESS HAVING EXCELLENT WELDABILITY AND MINIMAL VARIATION OF STRUCTURE AND PHYSICAL PROPERTIES

BACKGROUND OF THE INVENTION

1. Field of the Invention

The present invention relates to a method of manufacturing a steel product such as a thick steel plate, steel strip, shape steel, steel bar and the like io used in the fields of construction, ocean structures, pipes, ship building, reservoirs, civil engineering, construction machinery and the like, and, in particular, a thick steel product of high strength and high toughness having excellent weldability and minimal variation of structure and physical properties.

2. Description of the Related Art

A thick steel product such as thick steel plate has been used in various fields as described above and the characteristics thereof such as increased strength and toughness have been improved. In particular, recently, it is required that these characteristics are uniform in a thickness direction of the product, and less variable among a plurality of steel products.

One reason for that requirement is illustrated by the fact that, as buildings are made increasingly tall, they are designed so that vibration energy resulting from a large earthquake is absorbed by the controlled deformation of a building to prevent its chaotic collapse, as described in "Iron and Steel, 1988, No. 6" ("Testu to Hagane Dai 74 Nen (1988), Dai 6 Gou"), page 11–page 21. More specifically, when an earthquake occurs, the framework of the building is partially collapsed in a predetermined shape so that the total or chaotic collapse of the building is prevented by the plasticization of the framework. However, since this idea is based on the premise that when an earthquake occurs, the framework of a building exhibits a behavior intended by a designer, the designer must know precisely the yield strength ratio of the steel products used for the columns, beams and the like of the building. Therefore, it is indispensable that steel products such as steel plates, H-sections and the like used for the columns, beams and the like are uniform, and variation in the strength of the steel products is a serious problem.

Since it is necessary that steel products used for building and ship building have high tensile strength and high toughness, it is conventional to manufacture this type of steel product by a thermo-mechanical control process (hereinafter referred to as TMCP method). However, when thick steel products are made by the TMCP method, the structure of them is varied because the cooling rate in a cooling process executed after rolling is different along the thickness direction of a given product, or among several such products. This problem occurs because the cooling rate is large in the vicinity of the surface of the steel products when they are cooled, whereas the cooling rate is small at the center of the steel products, in thickness direction thereof. As a result, the material of the thus obtained steel products varies along the thickness direction of a given piece, and/or among a plurality of pieces. The variation of the material appears between the webs and between the flanges of an H-section due to the irregular cooling therebetween or among respective lots; additionally, it appears as a particular problem along the thickness direction of a thick steel plate.

To cope with the above problem, Japanese Unexamined Patent Publication No. 63-179020 discloses a method of reducing the difference of hardness of the cross section of a steel plate in a thickness direction by controlling components, a rolling reduction ratio, a cooling rate and a cooling finishing temperature. However, when a thick steel plate, in particular, a very thick steel plate having a thickness exceeding 50 mm is made, since a cooling rate inevitably varies along the thickness direction thereof, it is difficult to suppress the difference of hardness of the cross section in the plate thickness direction.

Japanese Unexamined Patent Publication No. 61-67717 discloses a method of greatly reducing the difference of strength in a plate thickness direction by greatly reducing a C content. As shown in FIG. 3 of the publication, however, the method cannot correct the variation of strength caused by the change of a cooling rate which inevitably arises particularly in a thick steel plate.

Japanese Unexamined Patent Publication No. 58-77528 describes that stable distribution of hardness is obtained by the complex addition of Nb and B. However, since the cooling rate must be controlled to the range of 15–40° C./sec to form bainite, and it is difficult to strictly control the cooling rate at the center of a plate in the thickness direction thereof, there is a problem that a uniform microstructure cannot be obtained in the thickness direction of the plate, strength is variable, and ductility and toughness are deteriorated due to the formation of island-shaped martensite.

Furthermore, it is important that the steel product used for the above applications have high toughness and a tensile strength greater than 570 MPa. For this purpose, a method of obtaining a fine tempered martensitic structure by a process of reheating, quenching and tempering has been mainly used. However, this method has a problem in that high cost is associated with the reheating, quenching and tempering process and further since a weld cracking parameter (hereinafter referred to as $P_{cm}$), which is the index of weldability, increases due to an increased quenching property, and weldability is thereby deteriorated.

On the other hand, Japanese Unexamined Patent Publication No. 62-158817 discloses a method of obtaining a thick steel plate having high strength at a relatively low $P_{cm}$ by executing a tempering process after rapid cooling while using the precipitation of Nb and Ti. In this method, however, there is a fear that distortion is caused by irregular cooling in addition to the high cost of a quenching and tempering process.

Likewise, although Japanese Unexamined Patent Publication No. 55-100960 discloses steel whose weldability is enhanced by regulating $P_{cm}$ and limiting the amounts of C, N and S, it is difficult to prevent the significant variation in strength along the thickness direction thereof.

Further, Japanese Unexamined Patent Publication No. 54-132421 discloses making high tension bainite steel by hot rolling executing at a finishing temperature of 800° C. or less to obtain toughness, and greatly reducing a C content to use the steel as pipeline raw material. However, this method has a problem that since the hot rolling is finished in a low temperature region, when a plate must be slit lengthwise, not only distortion and warping are liable to be caused by the slitting but also variation arises between the strength in a rolling direction (L direction) and the strength in the direction perpendicular to the L direction (C direction) by the rolling executed in the low temperature region.

An object of the present invention is to provide a method of manufacturing a steel product free from the above problems, that is, a steel product which is not restricted by the cooling rate after rolling, has minimal variation of microstructure along its thickness direction and among plural products, is excellent in weldability and has high toughness of 570 MPa or more in terms of tensile strength.

SUMMARY OF THE INVENTION

The variation of material properties of a thick steel plate is caused by the change in microstructure resulting from the great change of the cooling rate during a cooling process, along the thickness direction of the steel plate from the surface to the center thereof, or from the change of the cooling rate during the cooling process due to the variation of manufacturing conditions. It is important to obtain a homogenous microstructure despite operating over a wide range of cooling rate, to avoid variation of the material properties.

The inventors have found that careful selection of the constituent components of the steel composition permits the manufacture of a steel plate which has minimal variation of material properties and whose microstructure in a thickness direction is unchanged regardless of the change of a cooling rate, as a result of developing a method for obtaining a homogeneous microstructure even if the manufacturing conditions are changed. In particular, a bainite single phase structure can be made by the addition of Nb and B with ultra low C and a large amount of Mn, whose formation is independent of cooling rate.

According to the present invention, since the steel used in the present method contains ultra low C, martensite is not created even at a large cooling rate; moreover, since ferrite is not created due to the addition of high Mn, Nb and B even at a small cooling rate, a bainite single phase can be achieved over a wide range of cooling rate. As a result, the microstructure and strength of the steel are difficult to be affected by the cooling rate and the difference of strength among respective steel products is reduced.

The inventors have also found that since $P_{cm}$ is made small by sharply reducing the C content, not only excellent weldability is obtained but also sufficient strength is achieved by the bainite single phase and that sufficient toughness is obtained by achieving a granular bainite ferrite structure by formulating the composition such that a microstructure is formed even under a small rolling reduction as compared with a conventional low carbon bainite structure. The inventors have solved the above problems by comprehensively combining the above discoveries.

That is, the present invention is a method of manufacturing a thick steel product of high strength and high toughness having excellent weldability and minimal variation in structure and material properties, comprising the steps of heating a steel raw material to a temperature in the range from $AC_3$ to 1350° C., hot rolling and then cooling the steel raw material at a cooling rate of 10° C./sec or less. The steel raw material used in the present method comprises a composition containing the following components:

C: 0.001–0.025 wt %;
Mn: 1.0–3.0 wt %;
Ti: 0.005–0.20 wt %;
Nb: 0.005–0.20 wt %;
B: 0.0003–0.0050 wt %; and
Al: 0.01–0.100 wt % balance substantially Fe and incidental impurities, the composition having a transformation start temperature (Bs) of 670° C. or less.

Other aspects of the present invention will be apparent from the following detailed description.

DETAILED DESCRIPTION OF PREFERRED EMBODIMENTS

Initially, it will be described why the weight percent ranges of the respective chemical components of the steel product of the present invention are established in the manner disclosed.

C: 0.001–0.025 wt %

Although it is necessary to provide C in 0.001 wt % or more, when its content exceeds 0.025 wt % toughness is greatly decreased at a welded portion and it is difficult to make a microstructure to a granular bainite ferrite structure, so the C content is chosen to be 0.001–0.025 wt %.

Mn: 1.0–3.0 wt %

Mn should be contained in 1.0 wt % or more in order to lower the transformation start temperature, thereby to obtain a fine granular bainite ferrite structure. However, since toughness is deteriorated by a content exceeding 3.0 wt %, the range of from 1.0– 3.0 wt % is chosen.

Ti: 0.005–0.20 wt %

Ti should be present in an amount of 0.005 wt % or more to enhance the toughness in a heat affected zone (HAZ); however, its effect is saturated when the content exceeds 0.20 wt %, and so the upper endpoint of the range is set to 0.20 wt % simply from the view point of cost reduction.

Nb: 0.005–0.20 wt %

Nb should be present in an amount of 0.005 wt % or more to lower the transformation start temperature, thereby to obtain a fine granular bainite ferrite structure; however, its effect is likewise saturated when the content exceeds 0.20 wt %, and so the upper endpoint of the range is set to 0.20 wt % also for the sake of cost reduction.

B: 0.0003–0.0050 wt %

Addition of B in a slight amount is effective to restrict the creation of ferrite nuclei by reducing the grain boundary energy of the former γ grain boundary, and so it should be present in an amount of 0.0003 wt % or more to obtain a fine granular bainite ferrite structure. On the other hand, when the content of B exceeds 0.0050 wt %, toughness is deteriorated by formation of B compounds such as BN and the like, and so the range is set to 0.0003–0.0050 wt %.

Al: 0.01–0.100 wt %

Al is necessary in 0.01 wt % or more as a deoxidizing agent. However, since the cleanness of steel is deteriorated when its content exceeds 0.100 wt %, it should be present in an amount of 0.100 wt % or less.

Furthermore, it is important that the above components have a transformation start temperature ($B_s$) of 670° C. or less.

Figure 1:
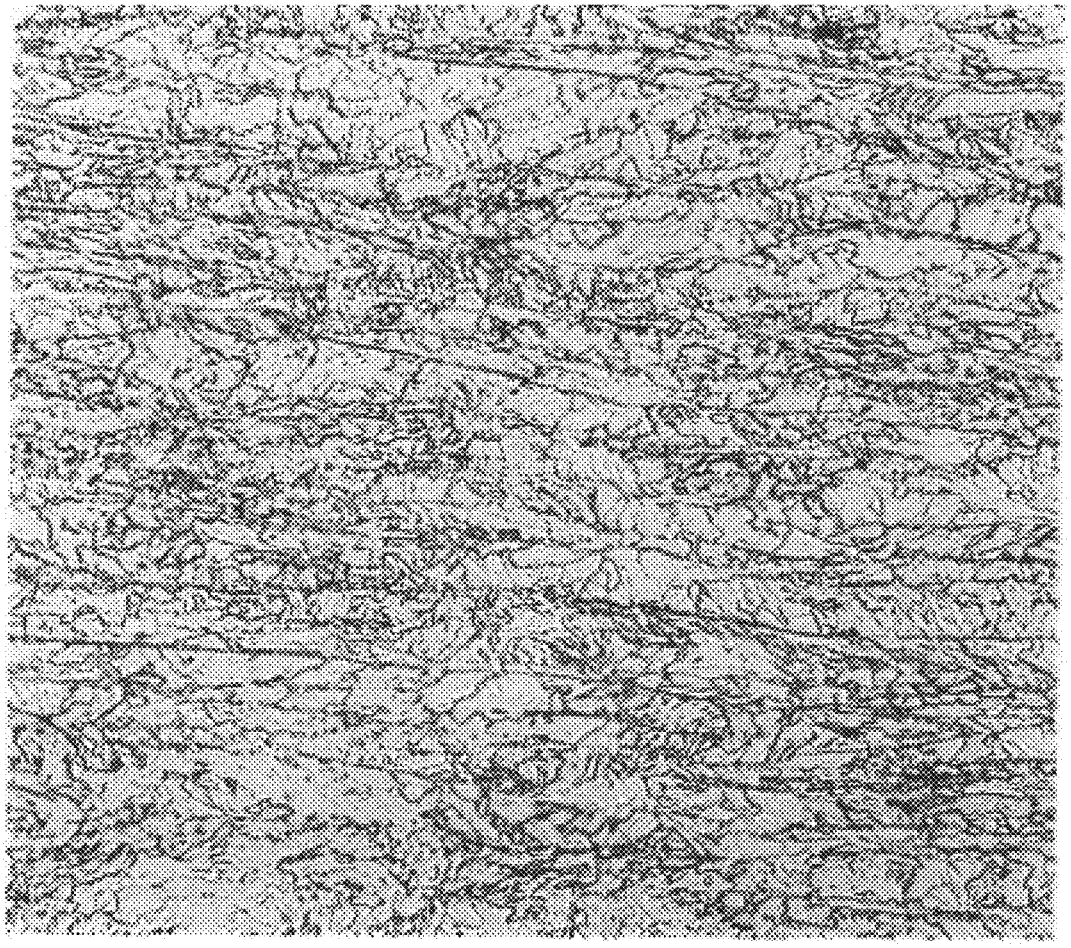
FIG. 1 is a photograph of the microscopic structure of a fine granular bainite ferrite structure.

That is, as a result of the diligent experimentation by the inventors as to the relationship between the toughness and the microstructure of ultra low carbon steel, the inventors have discovered that a fine granular bainite structure as shown more particularly in FIG. 1 has the greatest toughness among the microstructures of ultra low carbon steel. The control of the microstructure permitted the deterioration of toughness to be greatly reduced as compared with conventional steel, even if a rolling finish temperature was increased. When a method of obtaining this microstructure was examined, it was found that there was a good relationship between a microstructure and a transformation start temperature. This is because when steel products were obtained by changing rolling conditions from steels having various components in the range of C: 0.002–0.020 wt %, Mn: 1.2–2.0 wt %, Ni: 0.0–2.0 wt %, Ti: 0.01 wt %, Nb:

0.005–0.08 wt %, B: 0.0010–0.0018 wt %, Cu: 0.0– 1.22 wt % and Al: 0.01–0.100 wt % and the relationship between the transformation start temperature $B_s$ and the microstructure of the steel products was investigated while they were cooled after rolling, it was found that a fine granular bainite ferrite structure could be obtained when $B_s$ was set to 670° C. or less.

Still further, it is preferable that the composition of the above components satisfies the following formula (1) or (2).

$$130\ Mn+2500\ Nb \geqq 296 \quad (1)$$

$$130\ Mn-13Ni+2500\ Nb+55\ Cu \geqq 296 \quad (2)$$

Since the transformation start temperature $B_s$ was affected by the composition of the components, when multiple regression analysis was carried out as to the amounts of Mn, Ni, Nb and Cu which particularly greatly changed $B_s$, the relationship of $B_s$=966−130 Mn+13 Ni−2500 Nb−55 Cu could be obtained. On the other hand, since the granular bainite structure can be obtained by setting the transformation start temperature $B_s$ to 670° C. or less, it is important that the following formula be satisfied.

$$966-130\ Mn+13\ Ni-2500\ Nb-55\ Cu \leqq 670$$

The rearrangement of the above formula results in the following formula.

$$130\ Mn-13\ Ni+2500\ Nb+55\ Cu \geqq 296 \quad (2)$$

When the composition of the components of the above formula (2) does not contain Ni and Cu, the following formula (1) can be obtained.

$$130\ Mn+2500\ Nb \geqq 296 \quad (1)$$

Note, when the transformation start temperature $B_s$ exceeds 670° C., the fine granular bainite structure cannot be obtained as well as when the cooling rate after the rolling is reduced, strength is made insufficient by the precipitation of ferrite.

The present invention is further characterized in that a homogenous microstructure, more specifically, a microstructure at least 90% of which is composed of a granular bainite ferrite structure, can be obtained by adjusting the components to provide the above basic composition, virtually independent of the cooling rate after rolling. This feature will be apparent from the experiment whose results are shown in FIG. 2.

Figure 2:
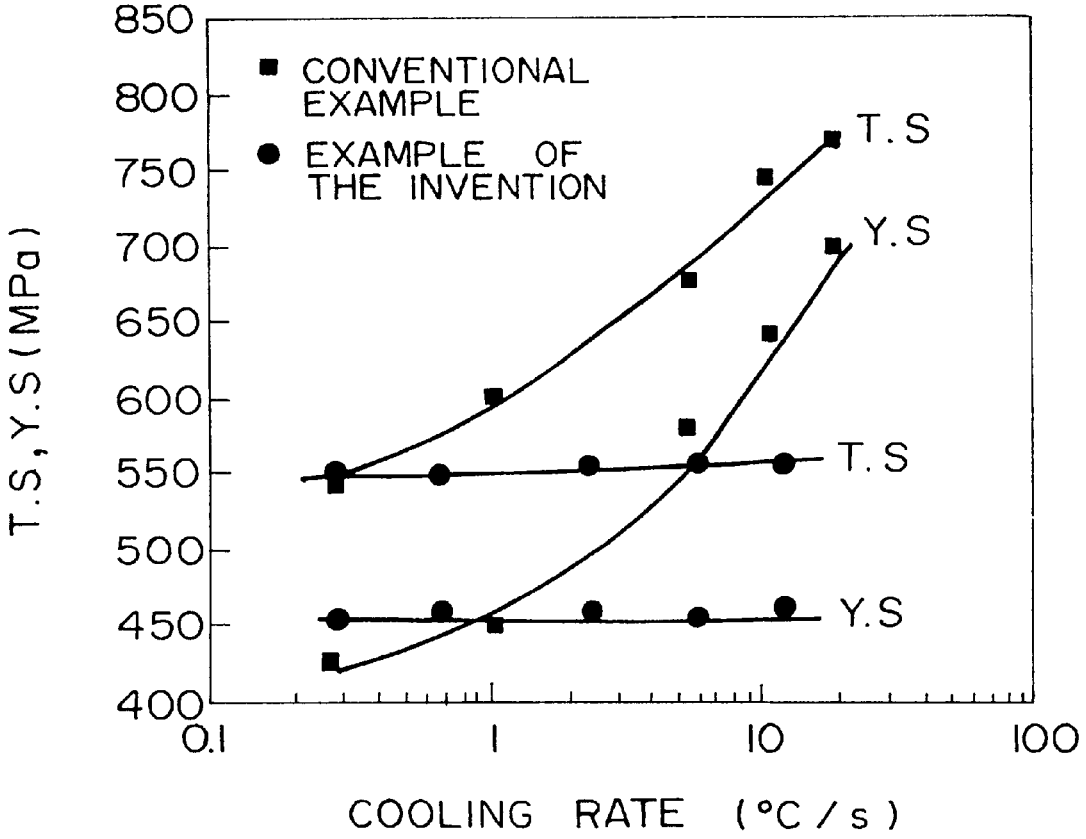
FIG. 2 is a graph showing the relationship between cooling rate and strength in a thick steel plate.

That is, FIG. 2 shows the result of investigation of the tensile strength of steel plates which were obtained by variously changing a cooling rate between 0.1° C./sec. and 50° C./sec. in the manufacturing process of steel whose components were adjusted according to the present invention (example of the present invention) and conventional steel (conventional example) used as building material. It is found from FIG. 2 that a definite strength can be obtained by the adjustment of the components according to the present invention without depending upon the cooling rate. In particular, the variation of the values of YS and TS is reduced over a wide range of the cooling rate, which could not be conventionally anticipated. This results from the addition of Mn, Ti and B in suitable amounts. Therefore, even if the cooling rate differs along the thickness direction of a thick steel plate, the strength is not correspondingly changed depending upon the cooling rate, and a thick steel plate whose microstructure and physical properties are more uniform along a thickness direction can be obtained.

Note, the example of the present invention contained C: 0.013 wt %, Mn: 1.60 wt %, Ti: 0.01 wt %, Nb: 0.065 wt %, B: 0.0015 wt % and Al: 0.035 wt % and the balance was Fe and incidental impurities. On the other hand, the conventional example contained C: 0.14 wt %, Si: 0.4 wt %, Mn: 1.31 wt %, Al: 0.024 wt %, Nb: 0.015 wt % and Ti: 0.013 wt %. Then, a series of thick steel plates having a thickness of 50 mm were made by changing the cooling rate in the same manufacturing process and there was measured the tensile strength of the test pieces obtained from the respective thick steel plates.

The simultaneous addition of V: 0.04–0.15 wt % and N: 0.0035–0.0100 wt % in addition to the above basic components can result in faster formation of fine bainite. That is, when V is used together with N, it has an action for creating a VN precipitate and increasing bainite transformed nuclei. For this purpose, V and N should be contained in at least 0.04 wt % and 0.0035 wt %, respectively. On the other hand, when V and N exceed 0.15 wt % and 0.0100 wt %, respectively, no improved is obtained in the more rapid formation of fine bainite, and, further, the toughness of a welded metal and at HAZ is deteriorated. Therefore, they are present in the ranges of V: 0.04–0.15 wt % and N: 0.0035–0.0100 wt %.

Additionally, the present invention can optionally control the level of strength and toughness by the addition of predetermined chemical components to the above basic components. At the time, since the homogeneous microstructure which has been achieved is not affected by the addition of the new components, a thick steel plate of high strength and/or high toughness with minimal variation of properties can be easily obtained.

First, at least one component selected from Si: 0.60 wt % or less, Cr: 0.2 wt % or less, Ni: 0.05–2.0 wt %, Mo: 0.5 wt % or less, W: 0.5 wt % or less, V: 0.005–0.04 wt % and Cu: 0.05–0.7 wt % can be added to enhance strength. Since these components are effective even if they are added in a slight amount, the lower limit of addition can be set as desired, with the exception of V. Note, when V is added in the range of from 0.04–0.15 wt % to make bainite fine as described above, an action similar to that shown below can be also expected.

Si: 0.60 wt % or less

Since weldability is impaired by a Si content exceeding 0.60 wt %, it is set to the range of 0.60 wt % or less.

Cr: 0.2 wt % or less

Although Cr is effective to increase the strength of a base metal and a welded portion, weldability and the toughness of HAZ are deteriorated by its presence in excess of 0.2 wt %, and so it is added in the range of 0.2 wt % or less. Note, it is preferable to add Cr in an amount of at least 0.05 wt % to achieve a sufficient strength increasing effect.

Ni: 0.05–2.0 wt %

Although Ni in an amount of 0.05 wt % or more enhances strength and toughness and also prevents cracks in rolling caused by the addition of Cu, since it is expensive and the excessive addition does not improve its effect, it is added in the range of 2.0 wt % or less.

Mo: 0.5 wt % or less

Although Mo is effective to increase strength at ordinary temperature and high temperature, since the addition of it exceeding 0.5 wt % deteriorates weldability, it is added in the range of 0.5 wt % or less. It is preferable to set the lower limit of addition to 0.05 wt %.

W: 0.5 wt % or less

Although W is effective to increase strength at high temperature, since it is expensive and the addition of it exceeding 0.5 wt % deteriorates toughness, it is added in the range of 0.5 wt % or less. Note, it is preferable to set the lower limit of addition to 0.05 wt %.

Cu: 0.05–0.7 wt %

Since Cu is effective to strengthen the precipitation and solid-solution of steel and lower the transformation start temperature $B_s$, it should be contained in 0.05 wt % or more. On the other hand, since the addition of it exceeding 0.7 wt % increases cost, it is added in an amount of 0.7 wt % or less.

V: 0.005–0.04 wt %

Although V is added in 0.005 wt % or more to strengthen precipitation and further to subject the former γ grains pinning as VN or VC, since the addition of it exceeding 0.04 wt % saturates its effect, the upper limit of addition is set to 0.04 wt %.

Further, at least one component selected from Ca and a rare earth metal (REM) may be added to enhance the toughness of HAZ.

Ca: 0.006 wt % or less

Although Ca is effective to enhance the toughness of HAZ by controlling sulfide inclusions, since the addition of it exceeding 0.006 wt % deteriorates the property of steel by forming coarse inclusions in the steel, it is added in 0.006 wt % or less.

REM: 0.02 wt % or less

Although REM enhances the toughness of HAZ by restricting as oxysulfide the growth of austenite grains, since the addition of it exceeding 0.02 wt % injures the cleanness of steel, it is added in 0.02 wt % or less.

Note, since the addition of Ca and/or REM below 0.001 wt % is insufficient to enhance the toughness of HAZ as described above, it is preferably added in 0.001 wt % or more.

Since the steel having the above components can achieve a homogenous granular bainite ferrite structure by controlling the components of it to the above basic composition, it is not necessary to strictly control manufacturing conditions. Thus, although it suffices only to make the steel plate according to the practice used in the manufacture of this type of the steel, the following manufacturing process can be advantageously employed to secure high strength and weldability together with the limited variation of the material and increased toughness.

That is, it is especially effective for increasing strength and enhancing weldability, to perform a process involving heating a steel slab whose components are adjusted as described above to a temperature within the range from the $AC_3$ point to 1350° C., and then cooling it at a rate of 10° C./sec. or less; or a process for heating the steel slab to the temperature of $Ac_3$ point—1350° C., and finishing the hot rolling of it at the final finishing temperature of 800° C. or more and then cooling it at the rate of 10° C./sec. or less.

A reason why the heating temperature is set to the $Ac_3$ point or higher is to render the microstructure homogeneous by initially making it austenitic; whereas the temperature is set to 1350° C. or less because the surface of a steel product is violently oxidized when the heating temperature exceeds 1350° C.

A reason why cooling rate is executed at 10° C./sec. or less is that when it exceeds 10° C./sec., it is more difficult to obtain a fine granular bainite ferrite structure, and toughness is deteriorated.

When hot rolling is executed, it is advantageous to set the final finishing temperature to 800° C. or more. That is, there is conventionally a problem that when the finishing temperature is lowered to secure toughness in Si—Mn steel, there is caused a difference (hereinafter denoted as difference of strength in L–C) between the strength in a rolling direction (L-direction) and the strength in the direction perpendicular to the L-direction (C-direction). To reduce the difference of strength in L–C, it is effective to increase the finishing temperature or reduce the rolling reduction ratio. When the finishing temperature is increased or the rolling reduction ratio is reduced as described above however, there arises a problem that a microstructure is not made fine and toughness is deteriorated.

On the other hand, since the composition of the components according to the present invention permits the fine granular bainite ferrite structure which is advantageous to toughness to be obtained without the execution of rolling, toughness is not deteriorated even if the finishing temperature is increased and the rolling reduction ratio is reduced and further a homogeneous and fine microstructure can be obtained without the execution of refining. Therefore, since the present invention does not suffer the conventional adverse affect, the difference of strength in L–C can be reduced by increasing the finishing temperature without sacrificing toughness.

Slabs of 100 mm thick were obtained by forging three types of steels, that is, a steel of the present invention (A) containing C: 0.013 wt %, Mn: 1.60 wt %, Ni: 0.3 wt %, Nb: 0.045 wt %, B: 0.0015 wt % and Cu: 0.5 wt %, a conventional steel (B) containing C: 0.15 wt %, Si: 0.3 wt %, Mn: 1.4 wt %, V: 0.05 wt % and Nb: 0.015 and a comparative steel (C) containing C: 0.022 wt %, Si: 0.30 wt %, Mn: 1.75 wt %, Nb: 0.043 wt %, Ti: 0.0015 wt % and B: 0.0012 wt %. These slabs were made into steel plates of 70 mm thickness in such a manner that they are heated at 1150° C. for one hour, rolled by reduction ratio 30% at various finishing temperatures and then cooled by air. Then, various mechanical properties were investigated in test pieces which were collected from the thus obtained steel plates at the portions of ½ and ¼ in their thickness direction. Table 1 shows the result of this investigation. As is apparent from Table 1, the toughness of the steel of the present invention is not deteriorated even if the finishing temperature is set to 800° C. or more at which the difference of strength in L–C is lowered.

TABLE 1

| Steel | Finished temp. (° C.) | T.S in L direction (MPa) | T.S in C direction (MPa) | Difference of strength in L-C (MPa) | 50% FATT (¼ thickness) (° C.) | 50% FATT (¼ thickness) (° C.) | Reference |
|---|---|---|---|---|---|---|---|
| A | 850 | 598 | 602 | 4 | −70 | −79 | Example of the inv. *1 |
| A | 800 | 595 | 598 | 3 | −73 | −84 | Example of the inv. |
| A | 750 | 586 | 611 | 25 | −83 | −94 | Example of the inv. |
| A | 700 | 583 | 637 | 54 | −88 | −100 | Example of the inv. |
| B | 850 | 509 | 510 | 1 | 20 | 0 | Conventional example |
| B | 800 | 510 | 512 | 2 | 15 | −10 | Conventional example |

TABLE 1-continued

| Steel | Finished temp. (° C.) | T.S in L direction (MPa) | T.S in C direction (MPa) | Difference of strength in L-C (MPa) | 50% FATT (¼ thickness) (° C.) | 50% FATT (¼ thickness) (° C.) | Reference |
|---|---|---|---|---|---|---|---|
| B | 750 | 503 | 524 | 21 | −10 | −25 | Conventional example |
| B | 700 | 505 | 525 | 20 | −20 | −45 | Conventional example |
| C | 850 | 613 | 615 | 2 | 5 | −30 | Comparative example |
| C | 800 | 612 | 615 | 3 | −25 | −60 | Comparative example |
| C | 750 | 607 | 622 | 15 | −45 | −75 | Comparative example |
| C | 700 | 601 | 628 | 27 | −64 | −95 | Comparative example |

*1: Example of the inv. means Example of the invention.

TABLE 2-1

| Symbol of steel | Chemical component (wt %) | | | | | | | | | | | | | | | | | Claimed formula *1 | Reference |
|---|---|---|---|---|---|---|---|---|---|---|---|---|---|---|---|---|---|---|---|
| | C | Si | Mn | Al | Nb | B | Cu | Ni | Ti | Mo | V | Cr | W | Ca | REM | N | P cm | | |
| 1 | 0.013 | — | 1.60 | 0.033 | 0.035 | 0.0013 | — | — | 0.01 | — | — | — | — | — | — | — | 0.100 | 296 | Example *2 |
| 2 | 0.006 | — | 1.80 | 0.025 | 0.048 | 0.0015 | — | — | 0.02 | — | — | — | — | — | — | — | 0.104 | 354 | Example |
| 3 | 0.003 | 0.35 | 1.80 | 0.040 | 0.035 | 0.0015 | 0.65 | 0.35 | 0.01 | — | — | — | — | — | — | — | 0.151 | 353 | Example |
| 4 | 0.015 | 0.25 | 1.55 | 0.035 | 0.035 | 0.0018 | 0.50 | 0.25 | 0.01 | — | — | — | — | — | — | — | 0.139 | 313 | Example |
| 5 | 0.045 | 0.35 | 1.80 | 0.035 | 0.026 | 0.0015 | 0.50 | 0.25 | 0.01 | — | — | — | — | — | — | — | 0.183 | 323 | Comp. ex. *3 |
| 6 | 0.006 | 0.80 | 1.85 | 0.050 | 0.010 | 0.0015 | 0.20 | 0.10 | 0.01 | — | — | — | — | — | — | — | 0.144 | 275 | Comp. ex. |
| 7 | 0.007 | 0.30 | 1.22 | 0.035 | 0.085 | 0.0012 | 0.50 | 0.25 | 0.01 | — | — | — | — | — | — | — | 0.113 | 395 | Example |
| 8 | 0.007 | 0.35 | 2.25 | 0.033 | 0.032 | 0.0010 | 0.50 | 0.25 | 0.01 | — | — | — | — | — | — | — | 0.165 | 397 | Example |
| 9 | 0.013 | 0.35 | 1.55 | 0.033 | 0.035 | 0.0010 | 0.30 | — | 0.01 | — | 0.038 | — | — | — | — | — | 0.126 | 306 | Example |
| 10 | 0.013 | 0.35 | 1.55 | 0.033 | 0.035 | 0.0010 | 0.30 | — | 0.01 | — | 0.022 | — | — | — | — | — | 0.124 | 306 | Example |
| 11 | 0.025 | 0.35 | 1.82 | 0.033 | 0.015 | 0.0010 | 0.50 | — | 0.01 | — | — | — | — | — | — | — | 0.158 | 302 | Example |
| 12 | 0.014 | 0.33 | 3.21 | 0.035 | 0.050 | 0.0015 | 0.40 | 0.20 | 0.02 | — | — | — | — | — | — | — | 0.216 | 562 | Comp. ex. |
| 13 | 0.005 | 0.30 | 1.85 | 0.210 | 0.008 | 0.0018 | 0.65 | 0.35 | 0.01 | — | — | — | — | — | — | — | 0.155 | 292 | Comp. ex. |
| 14 | 0.006 | 0.25 | 1.88 | 0.040 | — | 0.0015 | 0.20 | 0.10 | 0.01 | — | — | — | — | — | — | — | 0.128 | 254 | Comp. ex. |
| 15 | 0.008 | — | 1.60 | 0.040 | 0.015 | 0.0010 | 0.50 | 0.50 | 0.01 | — | — | — | — | — | — | — | 0.126 | 267 | Comp. ex. |
| 16 | 0.007 | 0.25 | 0.90 | 0.035 | 0.050 | 0.0013 | — | — | 0.01 | — | — | — | — | — | — | — | 0.067 | 242 | Comp. ex. |
| 17 | 0.015 | 0.25 | 2.05 | 0.055 | 0.015 | 0.0010 | 3.5 | 0.5 | 0.01 | — | — | — | — | — | — | — | 0.314 | 490 | Comp. ex. |

TABLE 2-2

| Symbol of steel | Chemical component (wt %) | | | | | | | | | | | | | | | | | Claimed formula *1 | Reference |
|---|---|---|---|---|---|---|---|---|---|---|---|---|---|---|---|---|---|---|---|
| | C | Si | Mn | Al | Nb | B | Cu | Ni | Ti | Mo | V | Cr | W | Ca | REM | N | P cm | | |
| 18 | 0.007 | 0.25 | 1.85 | 0.030 | 0.033 | 0.0015 | 0.3 | 0.1 | 0.30 | — | — | — | — | — | — | — | 0.130 | 335 | Comp. ex. |
| 19 | 0.014 | 0.28 | 1.60 | 0.040 | 0.028 | — | — | 0.2 | 0.01 | — | — | — | — | — | — | — | 0.106 | 276 | Comp. ex. |
| 20 | 0.006 | 0.30 | 1.78 | 0.025 | 0.043 | 0.0010 | 1.2 | 0.6 | 0.01 | — | — | — | — | — | 0.006 | — | 0.180 | 397 | Example |
| 21 | 0.007 | 0.30 | 1.58 | 0.030 | 0.050 | 0.0015 | 0.5 | 0.3 | 0.03 | 0.050 | — | 0.05 | — | — | — | — | 0.139 | 355 | Example |
| 22 | 0.012 | 0.01 | 1.56 | 0.033 | 0.055 | 0.0018 | 0.25 | — | 0.01 | — | 0.015 | — | — | — | — | — | 0.113 | 354 | Example |
| 23 | 0.005 | 0.05 | 1.55 | 0.035 | 0.055 | 0.0012 | 0.50 | 0.25 | 0.01 | — | — | — | 0.05 | 0.005 | — | — | 0.119 | 363 | Example |
| 24 | 0.018 | 0.30 | 1.75 | 0.040 | 0.043 | 0.0055 | — | — | 0.01 | — | — | — | — | — | — | — | 0.143 | 335 | Comp. ex. |
| 25 | 0.030 | 0.35 | 1.35 | 0.053 | — | — | 0.02 | 0.10 | — | 0.075 | 0.041 | 0.03 | — | — | — | — | 0.122 | 175 | Comp. ex. |
| 26 | 0.008 | — | 1.59 | 0.033 | 0.065 | 0.0013 | — | — | 0.01 | — | 0.115 | — | — | — | — | 0.0092 | 0.106 | 369 | Example |
| 27 | 0.009 | — | 1.80 | 0.025 | 0.048 | 0.0015 | — | — | 0.02 | — | 0.130 | — | — | — | — | 0.0066 | 0.120 | 354 | Example |
| 28 | 0.013 | 0.35 | 1.80 | 0.040 | 0.035 | 0.0015 | 0.65 | 0.35 | 0.01 | — | 0.150 | — | — | — | — | 0.0085 | 0.176 | 353 | Example |

TABLE 2-2-continued

| Symbol of steel | Chemical component (wt %) | | | | | | | | | | | | | | | | | Claimed formula *1 | Reference |
|---|---|---|---|---|---|---|---|---|---|---|---|---|---|---|---|---|---|---|---|
| | C | Si | Mn | Al | Nb | B | Cu | Ni | Ti | Mo | V | Cr | W | Ca | REM | N | P cm | | |
| 29 | 0.008 | 0.25 | 1.82 | 0.035 | 0.035 | 0.0018 | 0.50 | 0.25 | 0.01 | — | 0.107 | — | — | — | — | 0.0093 | 0.156 | 348 | Example |
| 30 | 0.008 | 0.30 | 1.22 | 0.035 | 0.085 | 0.0012 | 0.50 | 0.25 | 0.01 | — | 0.089 | — | — | — | — | 0.0043 | 0.123 | 395 | Example |
| 31 | 0.008 | 0.35 | 2.25 | 0.033 | 0.032 | 0.0010 | 0.50 | 0.25 | 0.01 | — | 0.126 | — | — | — | — | 0.0067 | 0.179 | 397 | Example |
| 32 | 0.007 | 0.30 | 1.78 | 0.025 | 0.043 | 0.0010 | 1.2 | 0.6 | 0.01 | — | 0.066 | — | — | — | 0.006 | 0.0080 | 0.188 | 397 | Example |
| 33 | 0.008 | 0.30 | 1.58 | 0.030 | 0.050 | 0.0015 | 0.5 | 0.3 | 0.03 | 0.050 | 0.068 | 0.05 | — | — | — | 0.0035 | 0.146 | 355 | Example |
| 34 | 0.014 | — | 1.59 | 0.033 | 0.055 | 0.0016 | 0.35 | — | 0.01 | — | 0.097 | — | 0.05 | — | — | 0.0089 | 0.129 | 363 | Example |
| 35 | 0.009 | 0.05 | 1.55 | 0.035 | 0.055 | 0.0012 | 0.50 | 0.25 | 0.01 | — | 0.117 | — | — | 0.005 | — | 0.0100 | 0.135 | 363 | Example |

*1: Claimed formula; 130Mn − 13Ni + 2500Nb + 55Cu
*2: Example means Example of the invention.
*3: Comp. ex. means Comparative example.

TABLE 3-1

| Symbol of steel | Heating temperature (° C.) | Thickness of slab (mm) | Thickness of plate (mm) | Rolling reduction ratio (%) | Finishing temp. (° C.) | Cooling method |
|---|---|---|---|---|---|---|
| 1 | 1150 | 100 | 70 | 30 | 900 | Air cooling |
| 2 | 1150 | 100 | 70 | 30 | 800 | Air cooling |
| 3 | 1180 | 310 | 100 | 67.7 | 800 | Air cooling |
| 4 | 1150 | 100 | 50 | 50 | 950 | Water cooling (3° C./s) |
| 4-1 | 1150 | 100 | 50 | 50 | 800 | Water cooling (15° C./s) |
| 5 | 1150 | 100 | 100 | 0 | — | Air cooling |
| 6 | 1150 | 100 | 30 | 70 | 830 | Air cooling |
| 7 | 1150 | 100 | 100 | 0 | — | Air cooling |
| 8 | 1150 | 100 | 70 | 30 | 830 | Water cooling (7° C./s) |
| 9 | 1150 | 100 | 70 | 30 | 920 | Air cooling |
| 10 | 1150 | 100 | 70 | 30 | 830 | Air cooling |
| 11 | 1150 | 100 | 70 | 30 | 800 | Air cooling |
| 12 | 1150 | 100 | 70 | 30 | 800 | Air cooling |
| 13 | 1150 | 100 | 70 | 30 | 800 | Air cooling |
| 14 | 1150 | 100 | 70 | 30 | 800 | Air cooling |
| 15 | 1150 | 100 | 70 | 30 | 800 | Air cooling |
| 16 | 1150 | 100 | 70 | 30 | 800 | Air cooling |
| 17 | 1150 | 100 | 70 | 30 | 800 | Air cooling |

TABLE 3-2

| Symbol of steel | Heating temperature (° C.) | Thickness of slab (mm) | Thickness of plate (mm) | Rolling reduction ratio (%) | Finishing temp. (° C.) | Cooling method |
|---|---|---|---|---|---|---|
| 18 | 1180 | 100 | 70 | 30 | 800 | Air cooling |
| 19 | 1150 | 100 | 70 | 30 | 800 | Air cooling |
| 20 | 1150 | 100 | 70 | 30 | 800 | Air cooling |
| 21 | 1150 | 100 | 70 | 30 | 980 | Air cooling |
| 22 | 1150 | 100 | 70 | 30 | 910 | Air cooling |
| 23 | 1150 | 100 | 70 | 30 | 900 | Air cooling |
| 24 | 1150 | 100 | 70 | 30 | 800 | Air cooling |
| 25 | 1150 | 100 | 70 | 30 | 800 | Air cooling |
| 26 | 1150 | 100 | 70 | 30 | 850 | Air cooling |
| 27 | 1150 | 100 | 70 | 30 | 800 | Air cooling |

TABLE 3-2-continued

| Symbol of steel | Heating temperature (° C.) | Thickness of slab (mm) | Thickness of plate (mm) | Rolling reduction ratio (%) | Finishing temp. (° C.) | Cooling method |
|---|---|---|---|---|---|---|
| 28 | 1180 | 310 | 100 | 67.7 | 800 | Air cooling |
| 29 | 1150 | 100 | 50 | 50 | 800 | Water cooling (3° C./s) |
| 30 | 1150 | 100 | 50 | 50 | 800 | Water cooling (15° C./s) |
| 31 | 1150 | 100 | 100 | 0 | — | Air cooling |
| 32 | 1150 | 100 | 70 | 30 | 830 | Water cooling (7° C./s) |
| 33 | 1150 | 100 | 70 | 30 | 800 | Air cooling |
| 34 | 1150 | 100 | 70 | 30 | 980 | Air cooling |
| 35 | 1150 | 100 | 70 | 30 | 850 | Air cooling |

TABLE 4-1

| Steel | TS-L (MPa) | TS-C (MPa) | YS-L (MPa) | YS-C (MPa) | 50% FATT-¼ × t (° C.) | 50% FATT-½ × t (° C.) | HAZvE-20 (J) | Crack preventing temp. (° C.) | Maximum hardness Hv | ΔHv | Reference |
|---|---|---|---|---|---|---|---|---|---|---|---|
| 1 | 612 | 613 | 472 | 474 | −70 | −65 | 301 | 20 | 159 | 8 | Example *1 |
| 2 | 615 | 617 | 475 | 457 | −65 | −60 | 297 | 20 | 163 | 10 | Example |
| 3 | 595 | 600 | 433 | 438 | −60 | −60 | 310 | 20 | 210 | 7 | Example |
| 4 | 601 | 605 | 488 | 490 | −80 | −75 | 304 | 20 | 195 | 12 | Example |
| 4-1 | 610 | 615 | 495 | 497 | 0 | 5 | 298 | 20 | 197 | 21 | Comp. ex. *2 |
| 5 | 613 | 615 | 488 | 490 | 20 | 45 | 8 | 20 | 240 | 43 | Comp. ex. |
| 6 | 660 | 662 | 547 | 550 | −25 | 5 | 7 | 20 | 220 | 8 | Comp. ex. |
| 7 | 600 | 601 | 453 | 456 | −55 | −50 | 312 | 20 | 160 | 8 | Example |
| 8 | 725 | 730 | 610 | 613 | −65 | −60 | 278 | 20 | 237 | 13 | Example |
| 9 | 620 | 621 | 482 | 484 | −75 | −70 | 301 | 20 | 162 | 8 | Example |
| 10 | 618 | 620 | 466 | 468 | −73 | −68 | 321 | 20 | 160 | 6 | Example |
| 11 | 631 | 633 | 486 | 490 | −66 | −66 | 291 | 70 | 159 | 11 | Example |
| 12 | 780 | 788 | 668 | 678 | −10 | 5 | 18 | 20 | 300 | 18 | Comp. ex. |
| 13 | 604 | 610 | 470 | 476 | 0 | 30 | 15 | 20 | 230 | 7 | Comp. ex. |
| 14 | 432 | 430 | 306 | 307 | −15 | 10 | 201 | 20 | 223 | 40 | Comp. ex. |
| 15 | 507 | 510 | 389 | 395 | −20 | 5 | 275 | 20 | 171 | 15 | Comp. ex. |
| 16 | 570 | 572 | 466 | 470 | −20 | 10 | 209 | 20 | 161 | 18 | Comp. ex. |
| 17 | 992 | 1014 | 951 | 963 | 30 | 60 | 10 | 150 | 420 | 13 | Comp. ex. |

TABLE 4-2

| Steel | TS-L (MPa) | TS-C (MPa) | YS-L (MPa) | YS-C (MPa) | 50% FATT-¼ × t (° C.) | 50% FATT-½ × t (° C.) | HAZvE-20 (J) | Crack preventing temp. (° C.) | Maximum hardness Hv | ΔHv | Reference |
|---|---|---|---|---|---|---|---|---|---|---|---|
| 18 | 662 | 663 | 553 | 557 | −30 | −10 | 235 | 20 | 273 | 17 | Comp. ex. |
| 19 | 480 | 487 | 378 | 383 | −40 | −15 | 245 | 20 | 207 | 38 | Comp. ex. |
| 20 | 618 | 622 | 488 | 491 | −60 | −60 | 324 | 20 | 165 | 11 | Example |
| 21 | 610 | 615 | 499 | 504 | −60 | −55 | 309 | 20 | 172 | 10 | Example |
| 22 | 600 | 603 | 479 | 481 | −65 | −60 | 275 | 20 | 157 | 9 | Example |
| 23 | 613 | 617 | 473 | 475 | −70 | −60 | 295 | 20 | 156 | 12 | Example |
| 24 | 612 | 615 | 495 | 498 | −60 | −25 | 105 | 20 | 270 | 28 | Comp. ex. |
| 25 | 412 | 410 | 287 | 290 | 10 | 35 | 120 | 70 | 291 | 58 | Comp. ex. |
| 26 | 622 | 623 | 480 | 482 | −79 | −73 | 305 | 10 | 183 | 7 | Example |
| 27 | 624 | 626 | 482 | 482 | −71 | −66 | 302 | 10 | 165 | 9 | Example |
| 28 | 608 | 613 | 442 | 447 | −69 | −69 | 315 | 10 | 238 | 6 | Example |
| 29 | 618 | 622 | 502 | 504 | −88 | −83 | 312 | 10 | 214 | 11 | Example |
| 30 | 623 | 624 | 471 | 474 | −64 | −58 | 316 | 10 | 179 | 7 | Example |
| 31 | 741 | 746 | 624 | 627 | −74 | −69 | 282 | 10 | 259 | 12 | Example |
| 32 | 630 | 634 | 498 | 501 | −68 | −68 | 328 | 10 | 191 | 10 | Example |
| 33 | 639 | 645 | 523 | 528 | −70 | −64 | 312 | 10 | 204 | 9 | Example |
| 34 | 619 | 622 | 494 | 496 | −74 | −69 | 280 | 10 | 190 | 8 | Example |
| 35 | 624 | 628 | 482 | 484 | −78 | −67 | 299 | 10 | 156 | 10 | Example |

*2: Example means Example of the invention.
*3: Comp. ex. means Comparative example.

EXAMPLE

Thick steel plates were made using steel slabs whose components were variously adjusted as shown in Tables 2-1 and 2-2 according to the conditions shown in Tables 3-1 and 3-2.

The mechanical properties of the thus obtained thick steel plates were investigated by executing a tensile test and a Charpy test. To evaluate the toughness of HAZ, Charpy test pieces were collected after the steel plates were heated to 1400° C. and then subjected to a heat cycle for cooling them from 800° C. to 500° C. in 15 seconds (which corresponded to the heat history of HAZ when a thick steel plate of 50 mm thick was welded with the amount of heat input of 45 kJ/cm) and the Charpy absorbed energy of them was measured at 0° C. A maximum hardness test was executed based on JIS Z3101 after the test pieces were welded at room temperature. Further, to evaluate the variation of strength in the thickness direction of the plates, the variation of hardness of the steel plates in the thickness direction was investigated by measuring the hardness of the cross section of the steel plates at the pitch of 2 mm.

Tables 4-1 and 4-2 shows the result of these investigations. As shown in Tables 4-1 and 4-2, it is found that the thick steel plates obtained according to the present invention have a tensile strength of 570 MPa or more and are excellent in toughness and since they have a uniform microstructure, the variation of hardness in a thickness direction is very small.

The steel products obtained by the present invention have no variation in physical properties or microstructure which would otherwise be caused by the cooling rate used in a cooling process when they are made in an industrial scale. Therefore, it is possible to provide a stable supply on an industrial scale of steel products of high strength and high toughness which have minimal variation of the material in a thickness direction and are excellent in weldability, the demand for which is expected to increase hereinafter. It will be understood that the present invention is also applicable to the field of section steels.

What is claimed is:

1. A method of manufacturing a thick steel product of a thickness of at least 50 mm and high strength and high toughness having excellent weldability and minimal variation in microstructure and physical properties, comprising the steps of heating a steel raw material to a temperature in a range from $Ac_3$ to 1350° C., hot rolling to a thickness of at least 50 mm at a final finishing temperature more than 800° C. and then cooling said steel raw material at a cooling rate of 10° C./sec. or less, wherein said steel raw material comprises a composition containing the following components:

C: 0.001–0.025 wt %;

Mn: 1.0–3.0 wt %;

Ti: 0.005–0.20 wt %;

Nb: 0.005–0.20 wt %;

B: 0.0003–0.0050 wt %; and

Al: 0.01–0.100 wt % balance essentially Fe and incidental impurities, said composition having a transformation start temperature ($B_s$) of 670° C. or less, wherein said composition satisfies the following formula:

$$130\ Mn+2500\ Nb \geqq 296 \quad (1).$$

.

2. The method according to claim 1, wherein said composition further comprises the following components:

V: 0.04–0.15 wt %; and

N: 0.0035–0.0100 wt %, wherein said composition further comprises at least one of the following components:

REM: 0.02 wt % or less; and

Ca: 0.006 wt % or less.

wherein said composition further comprises at least one of the following components:

Si: 0.60 wt % or less;

Cr: 0.2 wt % or less;

Ni: 0.05–2.0 wt %;

Mo: 0.5 wt % or less;

W: 0.5 wt % or less; and

Cu: 0.05–0.7 wt % wherein said composition further satisfies the following formula:

$$130\ Mn-13\ Ni+2500\ Nb+55\ Cu \geqq 296 \quad (2).$$

.

3. The method according to claim 1, wherein said composition further comprises the following components:

V: 0.005–0.04 wt %, wherein said composition further comprises at least one of the following components:

REM: 0.02 wt % or less; and

Ca: 0.006 wt % or less.

wherein said composition further comprises at least one of the following components:

Si: 0.60 wt % or less;

Cr: 0.02 wt % or less;

Ni: 0.05–2.0 wt %;

Mo 0.5 wt % or less;

W: 0.5 wt % or less; and

Cu: 0.05–0.7 wt % wherein said composition further satisfies the formula:

$$130\ Mn-13\ Ni+2500\ Nb+55\ Cu \geqq 296 \quad (2).$$

.

4. The method according to claim 1, wherein said composition further comprises the following components:

V: 0.04–0.15 wt %; and

N: 0.0035–0.0100 wt %.

5. The method according to claim 1, wherein said composition further comprises the following component:

V: 0.005–0.04 wt %.

6. The method according to claim 1, wherein said composition further comprises at least one of the following components:

Si: 0.60 wt % or less;

Cr: 0.2 wt % or less;

Ni: 0.05–2.0 wt %;

Mo: 0.5 wt % or less;

W: 0.5 wt % or less; and

Cu: 0.05–0.7 wt % wherein said composition further satisfies the following formula:

$$130\ Mn-13\ Ni+2500\ Nb+55\ Cu \geqq 296 \quad (2).$$

7. The method according to claim 1, wherein said composition further comprises at least one of the following components:

REM: 0.02 wt % or less; and

Ca: 0.006 wt % or less.

8. The method according to claim 1, wherein said composition further comprises the following components:

V: 0.04–0.15 wt %; and

N: 0.0035–0.0100 wt %, wherein said composition further comprises at least one of the following components:

Si: 0.60 wt % or less;

Cr: 0.2 wt % or less;

Ni: 0.05–2.0 wt %;

Mo: 0.5 wt % or less;

W: 0.5 wt % or less; and

Cu: 0.05–0.7 wt %, wherein said composition further satisfies the following formula:

$$130\ Mn-13\ Ni+2500\ Nb+55\ Cu \geqq 296 \quad (2).$$

9. The method according to claim 1, wherein said composition further comprises the following components:

V: 0.005–0.04 wt %;

wherein said composition further comprises at least one of the following components:

Si: 0.60 wt % or less;

Cr: 0.2 wt % or less;

Ni: 0.05–2.0 wt %;

Mo: 0.5 wt % or less;

W: 0.5 wt % or less; and

Cu: 0.05–0.7 wt %, wherein said composition further satisfies the following formula:

$$130\ Mn-13\ Ni+2500\ Nb+55\ Cu \geqq 296 \quad (2).$$

10. The method according to claim 1, wherein said composition further comprises the following components:

V: 0.04–0.15 wt %; and

N: 0.0035–0.0100 wt %, wherein said composition further comprises at least one of the following components:

REM: 0.02 wt % or less; and

Ca: 0.006 wt % or less.

11. The method according to claim 1, wherein said composition further comprises the following components:

V: 0.005–0.04 wt %, wherein said composition further comprises at least one of the following components:

REM: 0.02 wt % or less; and

Ca: 0.006 wt % or less.

* * * * *